US010247012B2

(12) United States Patent
Kirollos et al.

(10) Patent No.: US 10,247,012 B2
(45) Date of Patent: Apr. 2, 2019

(54) AEROFOIL BLADE OR VANE

(71) Applicant: ROLLS-ROYCE plc, London (GB)

(72) Inventors: Benjamin Kirollos, Oxford (GB); Thomas Povey, Oxford (GB)

(73) Assignee: ROLLS-ROYCE plc, London (GB)

( * ) Notice: Subject to any disclaimer, the term of this patent is extended or adjusted under 35 U.S.C. 154(b) by 398 days.

(21) Appl. No.: 14/964,091

(22) Filed: Dec. 9, 2015

(65) Prior Publication Data

US 2016/0177741 A1 Jun. 23, 2016

(30) Foreign Application Priority Data

Dec. 18, 2014 (GB) ..... 1422593.2

(51) Int. Cl.
*F01D 5/18* (2006.01)
*F01D 9/04* (2006.01)
*F01D 25/12* (2006.01)

(52) U.S. Cl.
CPC ..... *F01D 5/187* (2013.01); *F01D 5/186* (2013.01); *F01D 9/041* (2013.01); *F01D 25/12* (2013.01); *F05D 2220/32* (2013.01); *F05D 2240/124* (2013.01); *F05D 2240/306* (2013.01); *F05D 2260/201* (2013.01); *F05D 2260/202* (2013.01)

(58) Field of Classification Search
CPC ..... F01D 5/187; F01D 5/188; F01D 5/189; F01D 25/12; F09D 9/041
USPC ..... 415/115
See application file for complete search history.

(56) References Cited

U.S. PATENT DOCUMENTS

| | | | | |
|---|---|---|---|---|
| 3,475,107 | A | 10/1969 | Auxier | |
| 5,464,322 | A * | 11/1995 | Cunha | F01D 5/187 415/115 |
| 7,527,474 | B1 * | 5/2009 | Liang | F01D 5/186 416/1 |
| 7,682,133 | B1 * | 3/2010 | Liang | F01D 5/187 416/97 R |
| 8,167,537 | B1 * | 5/2012 | Plank | F01D 5/147 415/115 |
| 9,777,581 | B2 * | 10/2017 | Nilsson | F01D 5/189 |
| 2008/0050241 | A1 | 2/2008 | Liang | |
| 2009/0274549 | A1 * | 11/2009 | Mitchell | F01D 5/182 415/115 |
| 2014/0093392 | A1 * | 4/2014 | Tibbott | F01D 5/189 416/97 R |

(Continued)

FOREIGN PATENT DOCUMENTS

| | | | |
|---|---|---|---|
| WO | 9845577 | A1 | 10/1998 |
| WO | 2014/163698 | A1 | 10/2014 |

OTHER PUBLICATIONS

Apr. 22, 2016 Extended Search Report issued in European Patent Application No. 15198663.5.

(Continued)

*Primary Examiner* — Timothy L Maust
(74) *Attorney, Agent, or Firm* — Oliff PLC

(57) ABSTRACT

An aerofoil blade or vane for the turbine of a gas turbine engine includes: an aerofoil leading edge; an aerofoil trailing edge; an aerofoil suction side; and at least one reverse-pass coolant passage, extending within the aerofoil blade or vane; wherein the at least one reverse-pass coolant passage includes a substantial reverse-pass portion in which, in use, coolant flows in a direction away from the trailing edge and towards the leading edge.

17 Claims, 11 Drawing Sheets

(56) References Cited

U.S. PATENT DOCUMENTS

| | | | | |
|---|---|---|---|---|
| 2015/0267557 | A1* | 9/2015 | Facchinetti | F01D 5/189<br>416/95 |
| 2016/0097286 | A1* | 4/2016 | Tibbott | F01D 5/188<br>415/1 |
| 2016/0177739 | A1* | 6/2016 | Ahmad | F01D 5/187<br>416/95 |

OTHER PUBLICATIONS

Jun. 11, 2015 Search Report issued in British Application No. GB1422593.2.

* cited by examiner

Suction-side surface removed

Pressure-side surface removed

Suction-side

Pressure-side

AEROFOIL BLADE OR VANE

TECHNICAL FIELD OF INVENTION

The present invention relates to an aerofoil blade or aerofoil vane for the turbine of a gas turbine engine. In particular, the invention relates to how such blades or vanes are cooled.

BACKGROUND OF INVENTION

The performance of gas turbine engines, whether measured in terms of efficiency or specific output, is improved by increasing the turbine gas temperature. It is therefore desirable to operate the turbines at the highest possible temperatures. For any engine cycle compression ratio or bypass ratio, increasing the turbine entry gas temperature produces more specific thrust (e.g. engine thrust per unit of air mass flow). However as turbine entry temperatures increase, the life of an un-cooled turbine falls, necessitating the development of better materials and the introduction of internal air cooling.

In modern engines, the high-pressure turbine gas temperatures are hotter than the melting point of the material of the blades and vanes, necessitating internal air cooling of these aerofoil components. During its passage through the engine, the mean temperature of the gas stream decreases as power is extracted. Therefore, the need to cool the static and rotary parts of the engine structure decreases as the gas moves from the high-pressure stage(s), through the intermediate-pressure and low-pressure stages, and towards the exit nozzle.

Internal convection and external fluid films are the prime methods of cooling the gas path components—aerofoils, platforms, shrouds and shroud segments etc. Cooling air from the compressor that is used to cool the hot turbine components is not used fully to extract work from the turbine. Therefore, as extracting coolant flow has an adverse effect on the engine operating efficiency, it is important to use the cooling air effectively.

Ever increasing gas temperature levels combined with a drive towards flatter combustion radial profiles, in the interests of reduced combustor emissions, have resulted in an increase in local gas temperature experienced by the extremities of the blades and vanes, and the working gas annulus end-walls.

A turbine blade or vane has a radially extending aerofoil portion with facing suction side and pressure side walls. These aerofoil portions extend across the working gas annulus. Cooling passages within the aerofoil portions of blades or vanes are typically fed cooling air by inlets at the ends of the aerofoil portions. Cooling air eventually leaves the aerofoil portions through exit holes typically positioned at the trailing edges and, in the case of blades, the tips. Some of the cooling air, however, can leave through film cooling holes formed in the suction side and pressure side walls.

FIGS. 1*a* and 1*b* show schematically a longitudinal cross-section through the interior of previous aerofoil portions of a blade or vane. Each cross-section contains the leading edge L and trailing edge T of the aerofoil portion. In the FIG. 1*a* arrangement, air (indicated by arrows) is bled into the aerofoil section at an inlet in approximately the radial direction, travels along a radially extending passage, and exhausts from the trailing edge at about 90° to the radial direction. The peak thermal load is generally towards the centre of the aerofoil is, as indicated in FIG. 1*a*. FIG. 1*b* shows another arrangement in which the coolant passage forms a loop around a fence F, with the intention of directing a larger portion of the cooling air to the area of greatest thermal load.

In the prior art, the coolant inside the aerofoil flows axially and/or radially. Axial flow is predominantly in the same direction as the mainstream around the aerofoil (i.e. from leading-edge to trailing-edge). The coolant is then ejected into the mainstream through the trailing-edge or film cooling holes. As the coolant is fed to one of the near end-wall regions of the blade/vane, this results in the coolant with highest cooling potential (i.e. at the lowest temperature) being fed to the area of the blade/vane with the lower cooling requirement.

Further, the maximum wall temperature is a primary factor in determining the life of the aerofoil. Aerofoil cooling designs therefore attempt to minimise the maximum wall temperature. The maximum wall temperature typically occurs at midspan at the trailing-edge (where the external film is least effective) and the leading-edge (where mainstream stagnation temperatures are high).

There are many types of trailing-edge geometry in the prior art; for example, impingement systems that lead on to pedestal banks. These systems aim to offset elevated levels of external heat load at the trailing-edge of the aerofoil by a corresponding increase in internal heat pick-up. In most aerofoil designs, the wall temperature in the trailing-edge region increases to a maximum at the trailing-edge overhang (where the coolant has been ejected and is mixing into the mainstream). Because of internal heat pick up, the internal coolant increases in temperature through the trailing-edge system. The ability of the coolant to pick up heat diminishes as the coolant temperature increases. Therefore, the coolant is least effective where cooling is needed most: in the trailing-edge overhang region.

The present invention aims to at least partially overcome the limitations discussed above.

STATEMENTS OF INVENTION

According to a first aspect of the invention there is provided an aerofoil blade or vane for the turbine of a gas turbine engine, the aerofoil blade or vane comprising: an aerofoil leading edge; an aerofoil trailing edge; an aerofoil suction side; and a first reverse-pass coolant passage, extending within the aerofoil blade or vane; wherein the first reverse-pass coolant passage includes a reverse-pass portion positioned at the aerofoil blade or vane midspan region on the aerofoil suction side, which is arranged in a predominantly trailing edge to leading edge direction and which portion extends along 20% or more of the aerofoil suction side streamwise surface distance (i.e. 20% or more of the distance travelled by the mainstream around the aerofoil over the suction side surface).

The reverse-pass portion of this arrangement extends over a significant portion of the suction side, providing an improved cooling profile. The reverse-pass portion can extend for 30% or more, optionally 50% or more, further optionally 70% or more, and still further optionally 90% or more of the aerofoil suction side streamwise surface distance. The midspan reverse pass portion of the first reverse-pas coolant passage can be positioned from between 20% to 80% along the extent of the aerofoil blade or vane, in a direction predominantly from a first lateral edge to a second lateral edge of the aerofoil blade or vane.

The first reverse-pass coolant passage can extend to a coolant outlet closer to the aerofoil trailing edge than the aerofoil leading edge. The outlet for the first reverse-pass coolant passage can be within 30% of the distance from the trailing edge to the leading edge, optionally within 20%, further optionally within 10%, and still further optionally within 5%. The outlet for the first reverse-pass coolant passage can be a trailing-edge slot. As such, the reverse-pass coolant passage may incorporate 'normal' ('non-reverse-pass') flow sections, such that the coolant can flow towards the leading edge (reverse-flow) before being redirected to the trailing edge ('normal' flow). This can allow the exhausting of coolant that has undergone a significant pressure drop, whilst still allowing for the benefit of reverse-pass cooling portion to be obtained.

The first reverse-pass coolant passage can include a portion extending from an outlet of the reverse-pass portion in a direction predominantly from a first lateral edge to a second lateral edge of the aerofoil blade or vane. That is, in use, this portion extends predominantly radially along the blade or vane. The portion extending in a direction predominantly from the first lateral edge to the second lateral edge of the aerofoil blade or vane (40) can extend for a distance of 20% or more of the leading edge, optionally 30% or more, further optionally 50% or more.

The first reverse-pass coolant passage can include a normal-pass portion, extending along the suction side, from an outlet of the portion extending from a first lateral edge to a second lateral edge, in a predominantly leading edge to trailing edge direction. That is, in use, coolant flowing through this passage will flow in predominantly the opposite direction to coolant in the reverse-pass portion. The normal pass portion can extend along a lateral edge of the aerofoil blade or vane.

The aerofoil blade or vane can further comprise a second reverse-pass coolant passage that extends along the suction side to a coolant outlet closer to the aerofoil leading edge than the trailing edge. As such the second type of coolant passage can be entirely 'reverse-pass'. The outlet for the second reverse-pass coolant passage can be within 30% of the distance from the leading edge to the trailing edge, optionally within 20%, further optionally within 10%, and still further optionally within 5%. The outlet for the second reverse-pass coolant passage can comprise at least one row of suction-side film cooling holes. The at least one row of film cooling holes can be positioned so as to produce, in use, a pressure ratio of 1.02 or more between coolant exiting the second reverse-pass passage and the external mainstream.

The portion of the first passage extending in a direction predominantly from the first lateral edge to the second lateral edge of the aerofoil blade or vane can be separated from the suction side by the second reverse-pass passage.

The aerofoil blade or vane can further comprise: a plurality of said second reverse-pass coolant passages; and a leading edge plenum, extending 90% or more along the leading edge within the aerofoil blade and vane, in fluid communication with the coolant outlet at the leading edge; wherein the leading edge plenum forms a final section of each of the second reverse-pass coolant passages.

The aerofoil blade or vane can further comprise at least one aerofoil coolant inlet at one of its lateral edges. Inlets at both edges can allow for more equal coolant distribution, but in some cases it can be desirable to only have one inlet.

The aerofoil blade or vane can further comprise an internal pressure-side plenum that is connected to the aerofoil coolant inlet, and which is further connected to the first reverse-pass coolant passage, or first and second reverse-pass passages, via a cooling passage inlet. The internal plenum can allow for the collection and distribution of the coolant without taking up space at the suction side, thereby maximising the area available for the reverse-pass coolant passages. The plenum can also allow for coolant to be used for pressure-side cooling before being directed to the suction side.

The cooling passage inlet can be an impingement plate. The internal pressure-side plenum can extend across 50% or more of the pressure-side surface, optionally 60% or more, further optionally 70% or more, further optionally 80% or more, and still further optionally 90% or more. The inlet can be positioned at 60% or greater along the streamwise surface distance on the suction side, optionally at 70% or greater, further optionally at 80% or greater, and still further optionally at 90% or greater. In this way, the reverse-pass coolant passages can extend along a significant portion of the suction side surface, whilst any directly-fed 'normal' flow passages will provide the greatest cooling benefit to the trailing edge.

The aerofoil blade or vane can further comprise at least one non-reverse-pass coolant passage extending from a or the impingement plate. The at least one non-reverse-pass coolant passage extends to a coolant outlet closer to the aerofoil trailing edge than the aerofoil leading edge. That is, the trailing edge can be directly cooled by coolant that has not been part of a reverse-pass flow.

According to another aspect of the invention, there is provided a gas turbine comprising at least one aerofoil blade or vane according to any of the variations of the previous aspect.

DESCRIPTION OF DRAWINGS

The invention is discussed below, by way of non-limiting example only, with reference to the accompanying Figures, in which.

DETAILED DESCRIPTION OF INVENTION

Internal cooling designs for aerofoils, such as for a blade or vane for a turbine of a gas turbine engine, are presented below. Each design incorporates a significant amount of 'reverse-pass' coolant flow (i.e. coolant inside the aerofoil that flows from the trailing-edge towards leading-edge, which is in the opposite direction to the mainstream flow outside the aerofoil). That reverse-pass coolant flow is preferably on the suction-side wall of the aerofoil. There are significant advantages associated with these reverse-pass systems, including (a) improved cooling efficiency, i.e. less coolant is needed to achieve cooling to the same maximum wall temperature, or a smaller maximum wall temperature is achieved for the same amount of coolant, and (b) more uniform wall temperatures in the axial direction, which in turn reduces thermal stresses. The designs presented seek to maximise the number and/or length of reverse-pass portions, whilst satisfying manufacturability and pressure margin constraints.

Figure 1A:
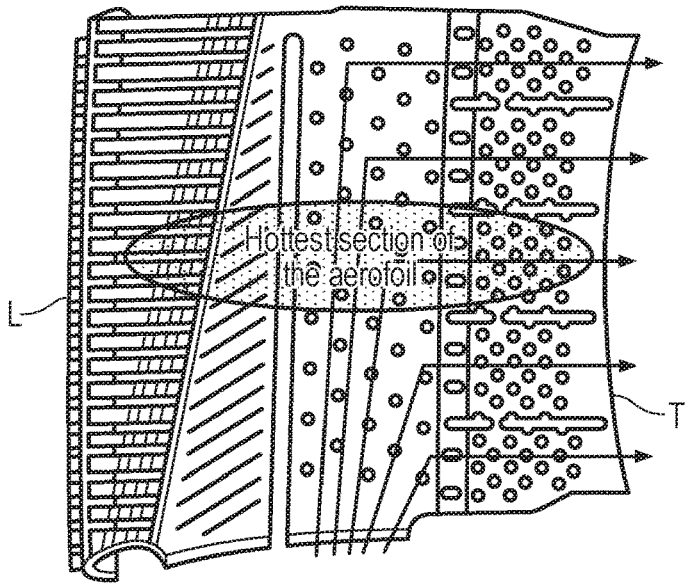
FIGS. 1*a* and 1*b* are schematic longitudinal cross-sections through the interior of previous aerofoil portions of a blade or vane.
Figure 1B:
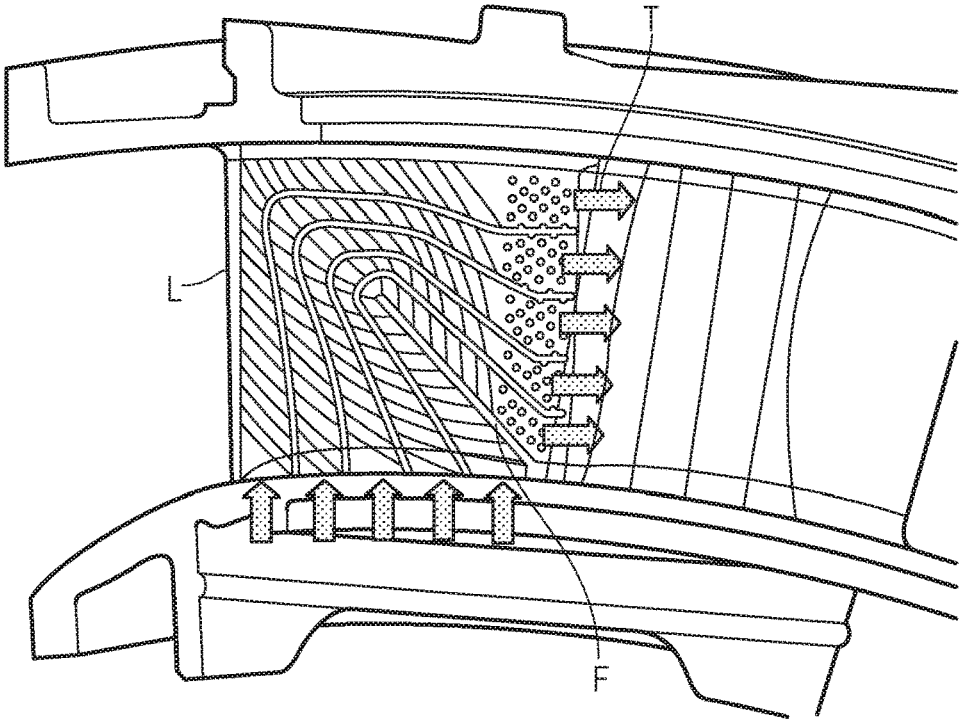
Figure 2:
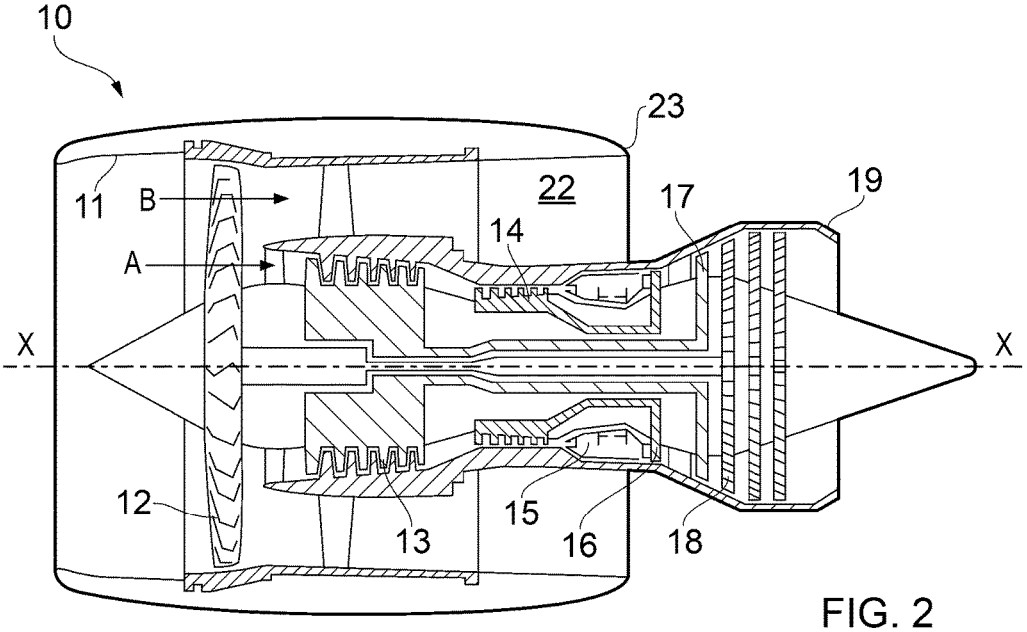
FIG. 2 is cross sectional view through a rotary device.

FIG. 2 is a cross sectional view through a ducted fan gas turbine engine 10, having a principal and rotational axis X-X. The engine 10 comprises, in axial flow series, an air intake 11, a propulsive fan 12, an intermediate pressure compressor 13, a high pressure compressor 14, combustion equipment 15, a high-pressure turbine 16, and intermediate pressure turbine 17, a low-pressure turbine 18 and a core engine exhaust nozzle 19. The engine also has a bypass duct 22 and a bypass exhaust nozzle 23. The gas turbine engine 10 works in a conventional manner so that air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines 16, 17, 18 respectively drive the high and intermediate pressure compressors 14, 13 and the fan 12 by suitable interconnecting shafts.

Figure 3:
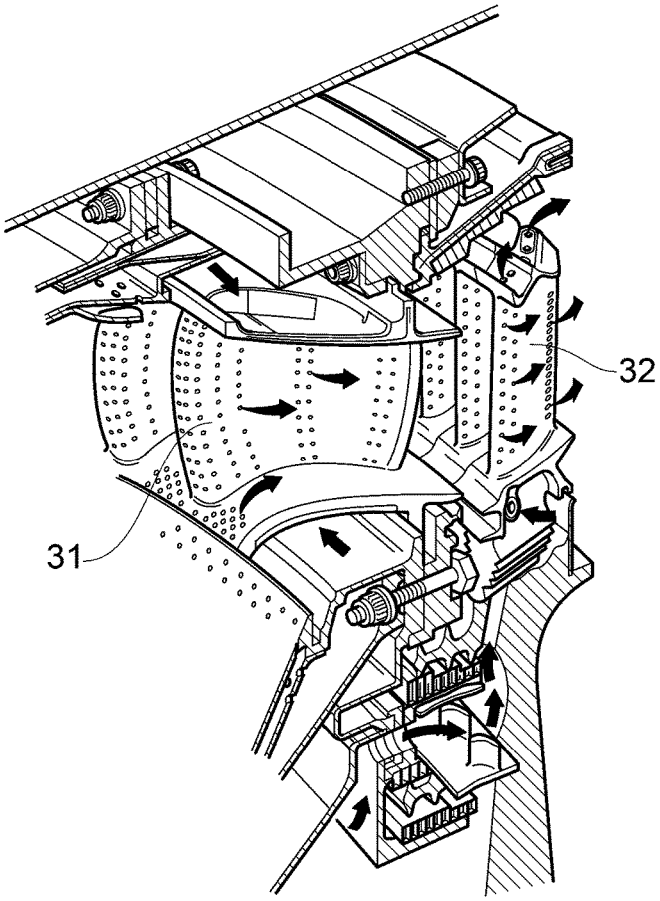
FIG. 3 is an isometric view of a single stage of a cooled turbine.

FIG. 3 shows an isometric view of a typical single stage of a cooled turbine. High-pressure turbine nozzle guide vanes (NGVs) 31 consume the greatest amount of cooling air on high temperature engines. During its passage through the engine, the mean temperature of the gas stream from the combustor 15 decreases, and so high-pressure blades 32 require less cooling, and typically use about half of the NGV 31 cooling flow. The intermediate-pressure and low-pressure stages further downstream of the HP turbine use progressively less cooling air.

The high-pressure turbine aerofoils are cooled by using high pressure air that has by-passed the combustor and is therefore relatively cool compared to the gas temperature of the air that passed through the combustor. Typical cooling air temperatures are between 800 and 1000 K, while gas temperatures can be in excess of 2100 K.

FIGS. 4 to 16 relate to a '3D' coolant passage design, for an aerofoil blade or vane for the turbine of a gas turbine engine, that includes two types of reverse-pass passage, catering for the non-uniform 3D distribution of external heat load. This generates a flatter wall temperature distribution both the spanwise direction streamwise direction across the aerofoil. The two types of reverse-pass passage, in this example, are: (1) off-midspan reverse-pass passages 42 in which the coolant travels towards the leading edge L before being ejected out of the leading edge L; and (2) a midspan reverse-pass passage 41 in which the coolant travels towards the leading edge, and then is routed, via a split into two paths, under the off-midspan reverse-pass passages 42 (under meaning away from the external aerofoil surface), before being directed out of the trailing edge T.

This design is discussed in more detail below, after a summary of what is shown in the individual figures.

Figure 4:
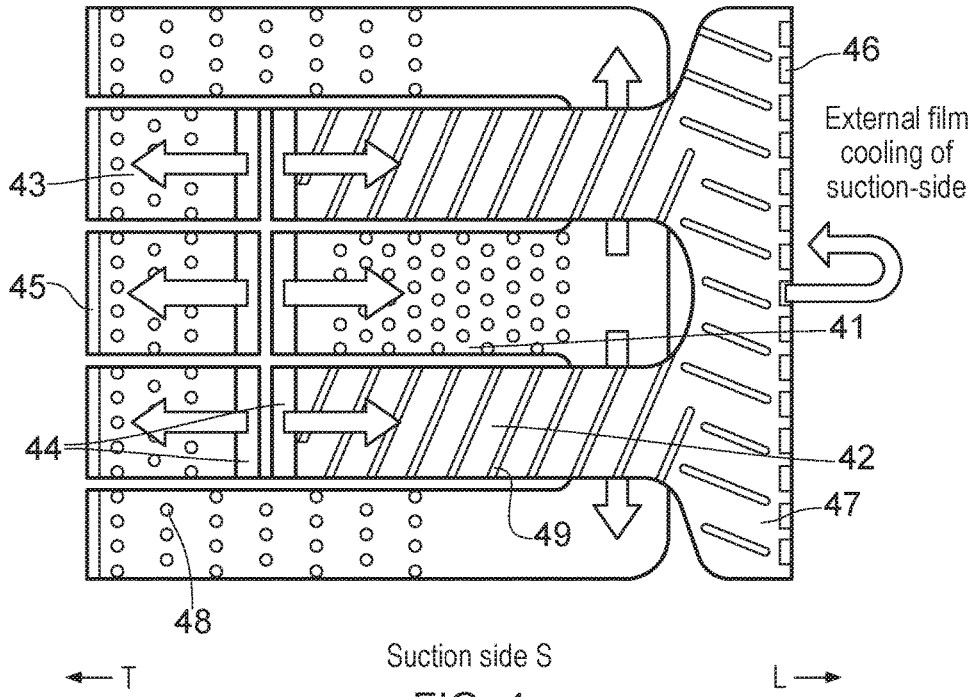
FIG. 4 shows a schematic plan view of a 3D layout of coolant passage passages, viewed from the suction side.

FIG. 4 shows a schematic plan view of the layout of coolant passage passages 41, 42, 43 within a aerofoil blade or aerofoil vane 40. The coolant flow through the passages 41, 42, 43 is shown by arrows. The coolant passages are preferably contained with the suction-side wall of the aerofoil 40.

Figure 5:
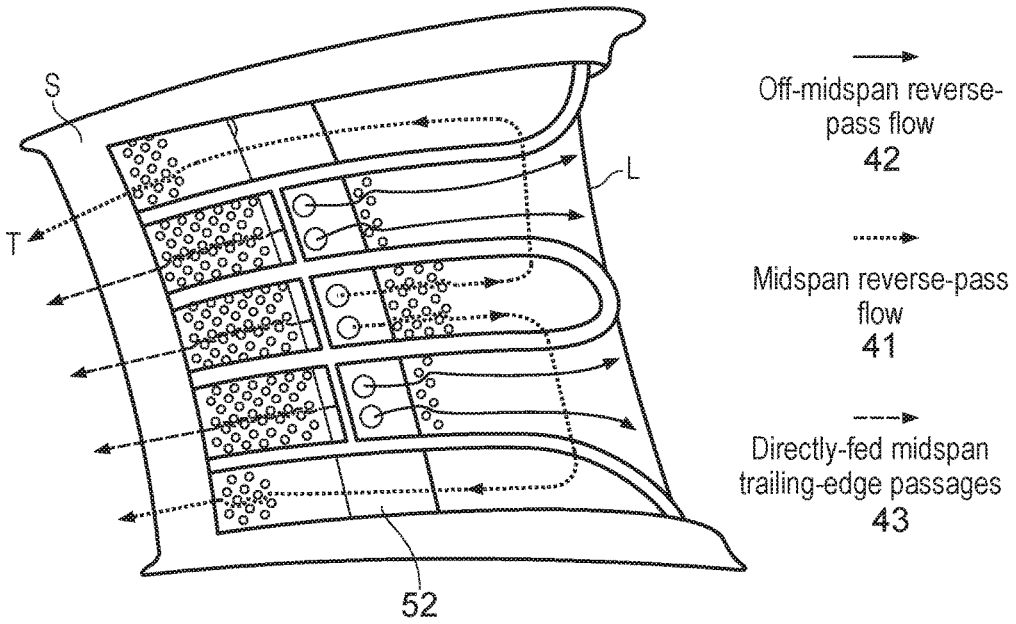
FIG. 5 is a view of the internal metal geometry for the passage layout of FIG. 4, as viewed from the suction side with the suction side surface removed, illustrating coolant flows.
Figure 6:
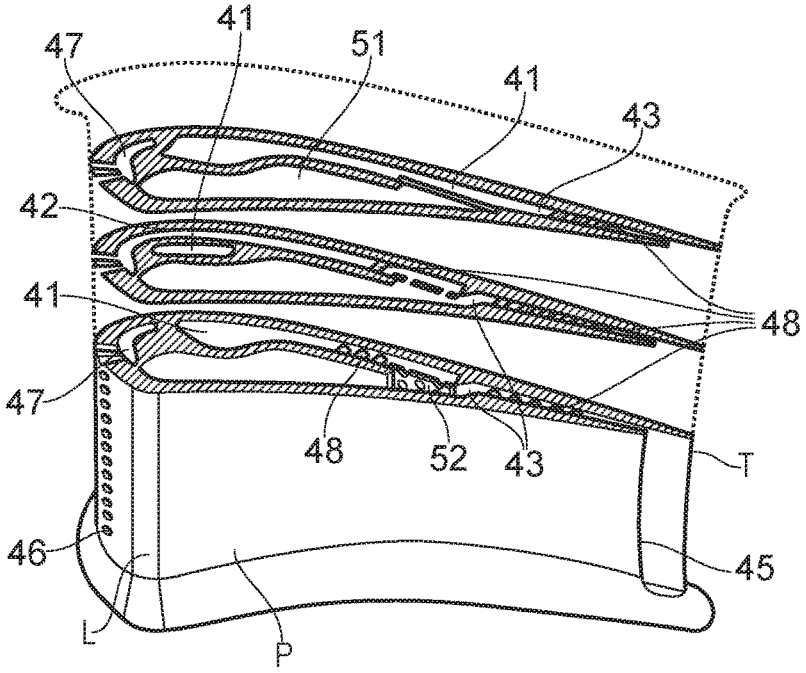
FIG. 6 shows a series of radial sections of the metal geometry of FIG. 5.
Figure 7:
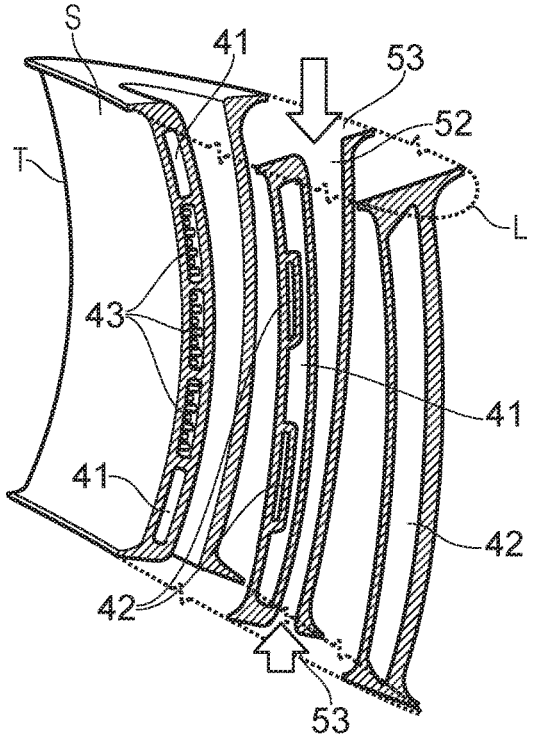
FIG. 7 shows a series of sections of the metal geometry of FIG. 5, perpendicular to the radial plane.
Figure 8A:
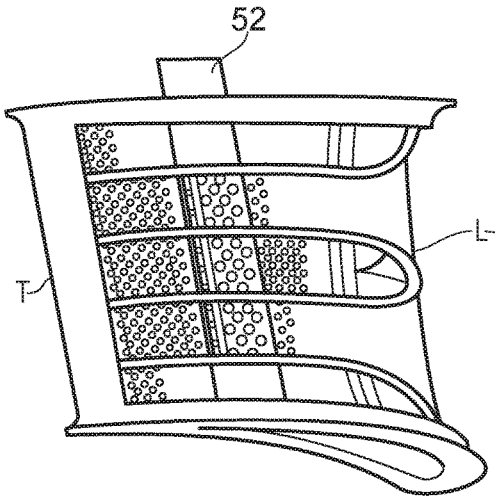
FIG. 8*a* shows a view of the metal geometry from the suction side, with the suction-side surface removed.
Figure 8B:
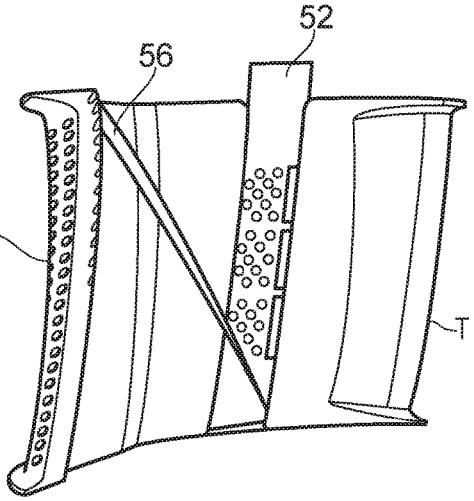
FIG. 8*b* shows a view of the metal geometry from the pressure-side with the pressure side external surfaces removed.

FIGS. 5 to 8 show the 3D metal geometry of the coolant passages 41, 42, 43 within the aerofoil 40. FIG. 5 views the aerofoil from the suction-side (S), with the external suction-side surface removed in order to show the cooling arrangement. In FIG. 5, the upper edge of the aerofoil 40 is the case edge, whilst the lower edge is the hub edge. Coolant flow is indicated by the arrows in the Figure. FIG. 6 presents radial sections of the metal geometry: the lower-most section (in the image) passes through the midspan reverse-pass passage 41; the top-most section (in the image) passes through the case-offshoot of the midspan reverse-pass passage 41; the middle section (in the image) passes through the off-midspan reverse-pass passage 42. FIG. 7 presents sections perpendicular to the radial plane. FIG. 8 shows the metal geometry with the suction-side and the pressure-side external surfaces removed, and with an optional baffle plate 56 depicted.

Figure 9A:
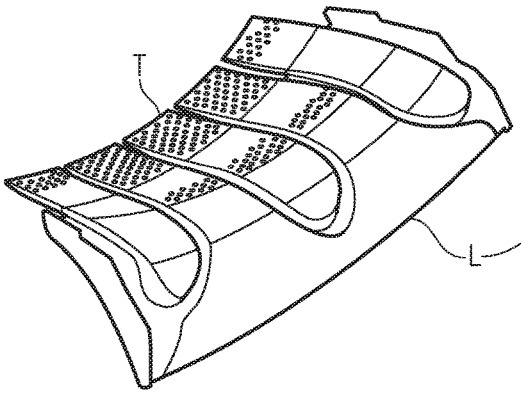
FIGS. 9*a* and 9*b* shows how the geometry of FIGS. 8*a* and 8*b* could be manufactured from a single core, from suction and pressure sides respectively.
Figure 9B:
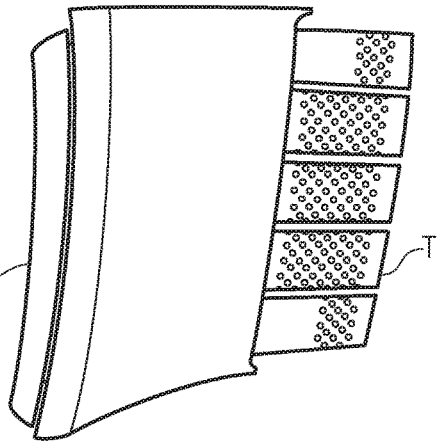
Figure 10A:
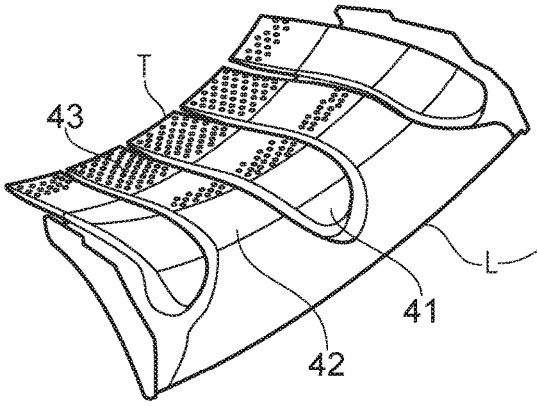
FIGS. 10*a* and 10*b* shows the core of FIGS. 9*a* and 9*b* with highlighting of individual sections.
Figure 10B:
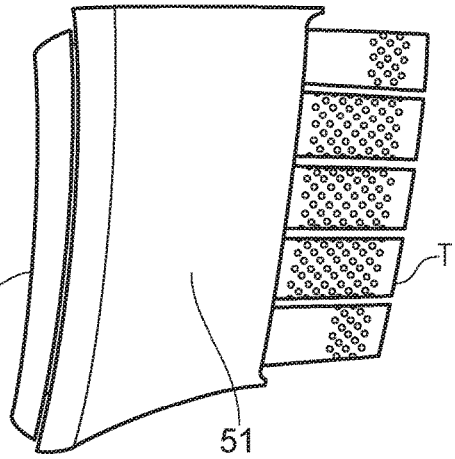
Figure 11:
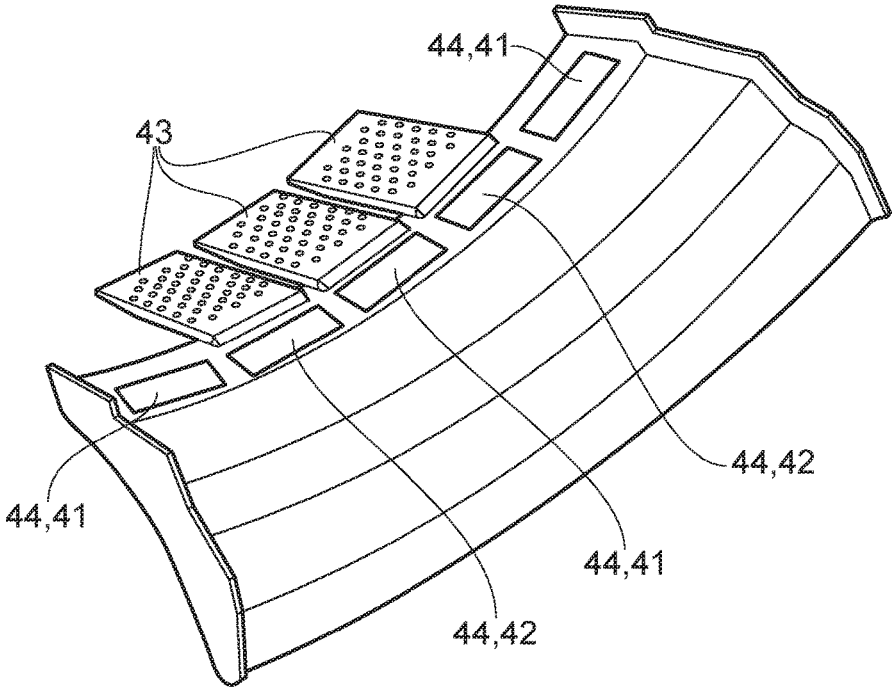
FIG. 11 illustrates how the main passages connect to the main plenum.
Figure 12:
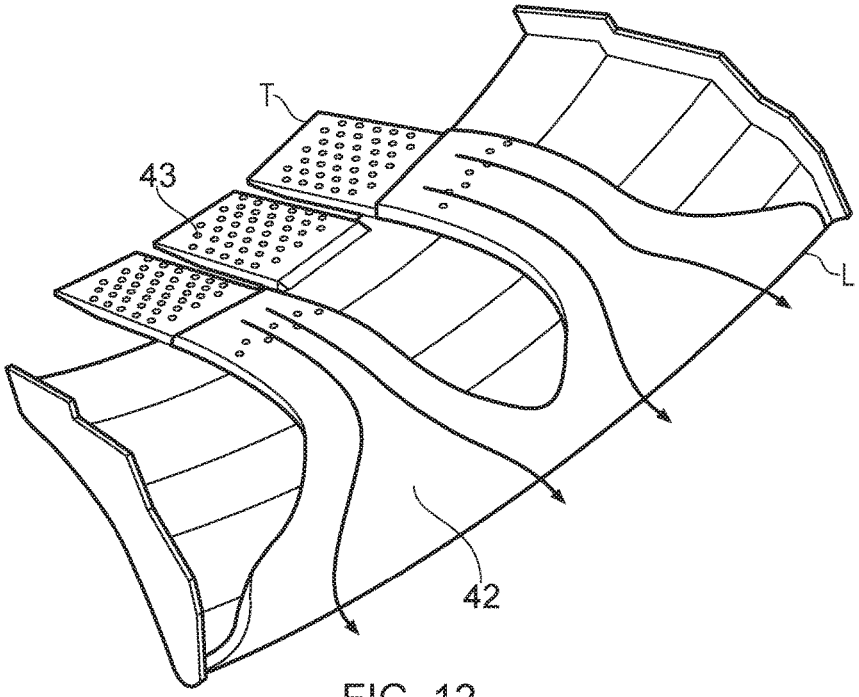
FIG. 12 illustrates flow through the off-midspan reverse-pass passage.
Figure 13:
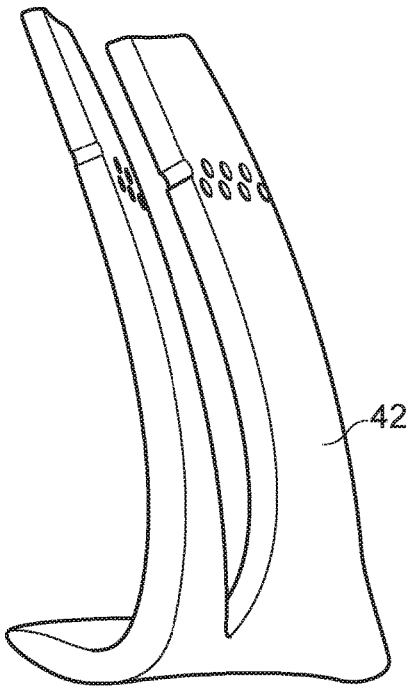
FIG. 13 is a close up view of the off-midspan reverse-pass passage.
Figure 14:
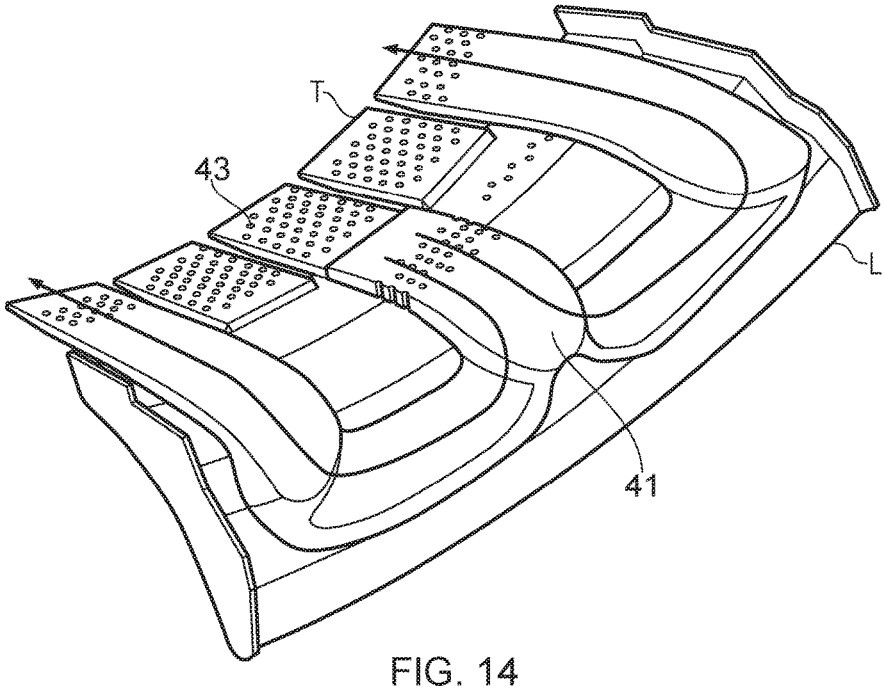
FIG. 14 illustrates flow through the midspan reverse-pass passage.
Figure 15:
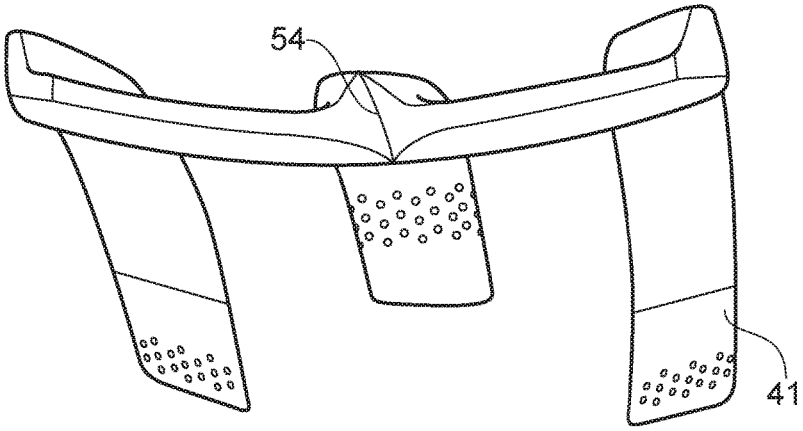
FIG. 15 is a close up view of the midspan reverse-pass passage.

FIGS. 9 to 15 show the core geometry, i.e. the inverse of the metal geometry or the coolant flow path. FIG. 9 shows how the geometry could be manufactured from a single core. FIG. 10 shows the core split into its main passages: the main plenum 51, the midspan reverse-pass passages 41 feeding the hub/case-offshoots, and the off-midspan reverse-pass passages 42. FIG. 11 illustrates how the main passages connect to the main plenum. FIGS. 12 and 13 illustrate the off-midspan reverse-pass passage 42 in particular, with coolant flow through the off-midspan reverse-pass passage 42 indicated by arrows in FIG. 12. FIGS. 14 and 15 illustrate the midspan reverse-pass passage 41 in particular, with coolant flow through the midspan reverse-pass passage 41 indicated by arrows in FIG. 14.

Figure 16:
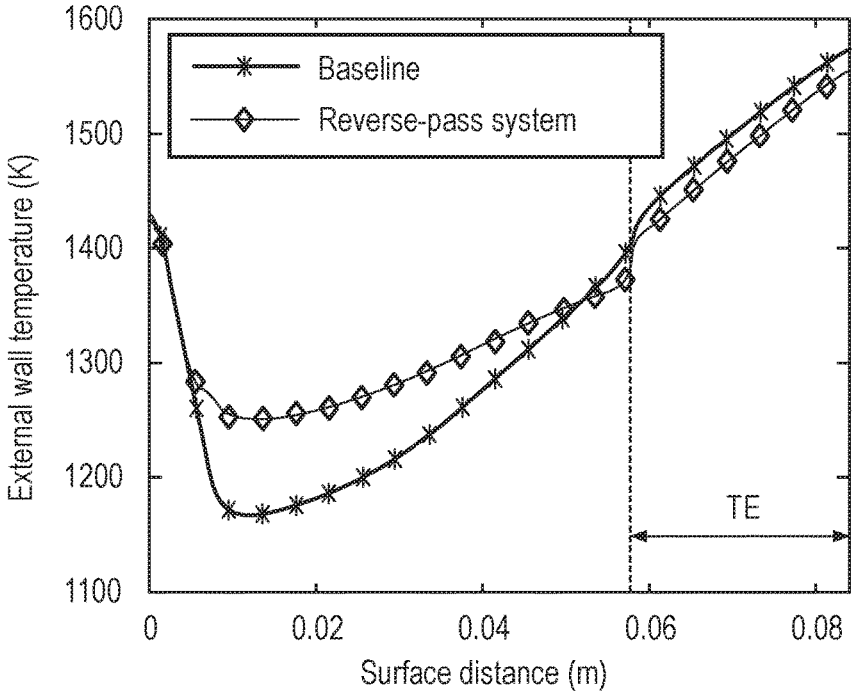
FIG. 16 is a graph showing temperature variations across the axial surface distance of a vane.

FIG. 16 illustrates the impact of the design on the temperature profile across the span of an aerofoil.

FIGS. 6 & 7 are useful illustrations for understanding how the coolant passages of the design relate to the overall aerofoil 40. Those figures show the aerofoil leading edge L and trailing edge T, as well as the aerofoil suction side S and pressure side P. In the context of an aerofoil vane 40, a hub and case will connect to either side of the aerofoil span. For a rotary aerofoil blade 40 one end of the aerofoil will be connected to a hub, but the other end will be free to allow rotation.

As can be seen in FIG. 7, the main plenum 51 is where coolant is first received into the aerofoil 40. In this design, the main plenum 51 can be fed by inlets 53 from both lateral sides (in use, these are the hub and case sides of the blade or vane), or from just one of the lateral sides. Feeding from both sides may not be practical for e.g. a rotary blade, but can be preferable for stationary vanes to assist even coolant and cooling distributions. The plenum 51 of a vane might also be fed only from the hub in order to reduce the risk of blockage from particulates.

The main plenum 51 extends over a significant section of the pressure-side P of the blade or vane 40. As such, coolant introduced into the main plenum 51 may perform some cooling duty on the pressure-side P of the blade 40, before being directed to the typically cooler suction-side S, as discussed below. The main plenum 51 can extend across 50% or more of the pressure-side surface (P), optionally 60% or more, further optionally 70% or more, further optionally 80% or more, and still further optionally 90% or more.

The main plenum 51 can directly feed coolant to some film cooling holes. However, as discussed below, at least some film cooling holes may serve as the outlet for the off-midspan reverse-pass passage 42, and so those film cooling holes are not directly fed by the main plenum 51.

The main plenum 51 also feeds the reverse-pass passages 41, 42 and the midspan trailing-edge passages 43.

In the depicted design, the coolant enters the reverse-pass passages 41, 42 and midspan trailing-edge passages 43 from the main plenum 51 through an impingement plate 52 (see FIGS. 5 and 6). In alternative designs, the impingement plate 51 could be part of the cast structure of the aerofoil 40 in order to reduce the number of components. As such, the impingement plate is one example of an entry point or inlet 44 into the reverse pass passages 41, 42 and also into the midspan trailing-edge passages 43.

The midspan trailing-edge passages 43 are now discussed in more detail.

The trailing-edge passages are provided across 20-80% of the trailing-edge span of this design. That is, they account for the central 60% of the span in this design, but other proportions can be used as required. The passages 43 are fed from the main plenum 51. The coolant does not flow through any reverse-pass system (or any other system) before entering the midspan trailing-edge passages 43 from the plenum 51. Further, the midspan trailing-edge passages 43 themselves do not incorporate any reverse-pass portions. As such, the midspan trailing-edge passages 43 are 'normal' or 'non-reverse-pass' coolant passages.

The inlet 44 ('inlet' here referring to where the coolant from the main plenum 51 enters the midspan trailing-edge passages 43, rather than the overall inlet 53 where coolant enters the aerofoil) to the midspan trailing-edge passages 43 preferably occurs as far back as is manufacturable, towards the trailing-edge T. This provides the greatest cooling potential to the trailing edge T. In this example, this happens at from 60 to 70% along the streamwise surface distance on the suction-side (that is 60-70% along the distance from the leading-edge L to the trailing-edge T, as measured along the suction surface S in the direction travelled by the mainstream around the aerofoil 40). In other examples, the inlet 44 can be at 60% or greater along the streamwise surface distance on the suction side S, optionally at 70% or greater, further optionally at 80% or greater, and still further optionally at 90% or greater. In general, moving the entry point 44 further back is easier in vanes with thicker aerodynamic profiles.

The midspan trailing-edge passages 43 contain a bank of pedestals 48. These pedestals 48 serve to increase coolant heat pick-up. In other arrangements, the pedestals could be replaced by turbulator ribs (such as ribs 49 shown in the off-midspan reverse-pass passage 42 in FIG. 4), corrugated patterns, or any other heat transfer enhancement features.

In the depicted design, there are three midspan trailing-edge passages 43. However, this is not a requirement, and other arrangements can have a different number of these midspan passages 43 (e.g. 1-5). The number of passages will be partly dictated by stress and manufacturability considerations, for example. Similarly, as mentioned above, the midspan trailing-edge passages take up 20-80% of the radial span in the design presented, but in other designs this may be adjusted to take up less/more radial span.

The midspan trailing-edge passages 43 are exhausted at the trailing edge slot 45, which also provides an outlet for the midspan reverse-pass passage discussed below. The trailing edge slot 45 is an outlet that is positioned in the vicinity of the trailing edge T, and as such is both closer to the trailing edge T than the leading edge L and is further back, in a streamwise direction, than the coolant passage inlet 44. Preferably, the outlet 45 is within 30% of the distance from the trailing edge (T) to the leading edge (L), optionally within 20%, further optionally within 10%, and still further optionally within 5%.

The exhausting of the directly fed midspan trailing-edge passage 43 at the trailing edge reduces the maximum trailing-edge T temperature, which occurs towards the midspan area of the trailing-edge T, taking into account the 3D nature of the heat load. The midspan trailing-edge T is typically one of the hottest parts of the aerofoil. By positioning the inlet 44 to the midspan trailing-edge cooling system 43 as far back as manufacturably viable, the cooling in this area can be improved. By simplifying and shortening the route of the coolant from the injection point 44, the coolant effectiveness at the trailing-edge can be improved (increased) and the trailing-edge temperature reduced, thus increasing life.

The hub and case portions of the trailing-edge T (e.g. from 0-20% and from 80-100% of the span, in the depicted design) usually have a lower external heat load than the midspan; for this reason, the coolant does not need to be as cold at the edges of the trailing edge T and therefore these areas need not be fed directly with coolant from the main plenum 51, in the same way as the midspan. This consideration, as well as the high pressure margin at the trailing-edge T, makes the hub/case portion of the trailing-edge a suitable location to exhaust the coolant from the midspan reverse-pass passage 41.

The midspan reverse-pass passage 41 is now discussed in more detail.

The midspan reverse-pass passage 41 cools the midspan region of the aerofoil 40, where the external heat load is highest. The passage 41 begins at from 60-70% streamwise surface distance, and covers span 40-60% (i.e. the passage 41 has a width 20% of the span of the aerofoil 40, starting at 40% across the span) in this example. The passage 41 runs from entry point 44 towards the leading-edge L of the aerofoil 40. As such, this portion of passage 41 is reverse-pass portion positioned at the aerofoil blade or vane 40 midspan region on the aerofoil suction side S, arranged in a predominantly trailing edge T to leading edge L direction. The midspan reverse pass portion can be positioned from between 20% to 80% along the extent of the aerofoil blade or vane 40, in a direction predominantly from a first lateral edge to a second lateral edge of the aerofoil blade or vane (40).

The midspan reverse-pass coolant passage 41 can contain a number (e.g. from 4 to 8, optionally six) rows of staggered pedestals 48 to increase coolant heat pick-up in the positions where the external heat load is highest. Other embodiments may use greater or fewer pedestals 48, or different heat transfer enhancement features, e.g. turbulator ribs, dimples, roughness elements, impingement systems. The number of pedestal rows in the midspan reverse-pass passage 41 is typically greater than the number of pedestal rows in the off-midspan reverse-pass passage 42 as the external heat load is greater at midspan.

At the point at which the midspan passage 41 cannot run any further towards the leading-edge L due the presence of other features (e.g. the off-midspan shared plenum 47, discussed in more detail below), the midspan reverse-pass passage 41 splits in two: one passage is directed approximately radially towards the hub under the hub-side off-midspan passage 42, the other is directed approximately radially towards the case under the case-side off-midspan passage 42. As such, these are two portions of the passage 41 each extending from an outlet of the reverse-pass portion in a direction predominantly from a first lateral edge to a second lateral edge of the aerofoil blade or vane 40. Each of these portions can extend for a distance of 20% or more of the leading edge L, optionally 30% or more, further optionally 50% or more.

Pressure losses arising from mixing/turbulence introduced by the split can be reduced by a snow-plough feature 54 on the leading edge L wall. In other arrangements, the split could take a different form to reduce/increase pressure loss and heat pick-up as required. For example, the split could occur at the entry to the midspan reverse-pass flow portion (e.g. at entry 44 from the main plenum 51) to further control coolant split. The midspan reverse-pass passage 41 may be split into two passages which are symmetric or asymmetric about the midspan. Splitting at entry may be done to control the coolant split between the hub and case offshoots of the midspan reverse-pass passage.

The split passages continue radially to 0 and 100% span, at which point they turn 90° and run towards the trailing-edge slot 45. That is, there are 'normal-pass' passage portions, extending along the suction side, from an outlet of the portion extending from a first lateral edge to a second lateral edge, in a predominantly leading edge L to trailing edge T direction. These normal pass portions extend along the lateral edges of the aerofoil blade or vane 40.

The hub- and case-offshoots of the midspan reverse-pass passage 41 take up 0-20% and 80-100% of the suction-side span of the aerofoil (i.e. each extend across 20% of the span) in this example.

Once emerging from underneath the off-midspan reverse-pass passages 42, the hub/case-offshoots of the midspan reverse-pass passage move as close to the external aerofoil suction surface S as possible, in the same way as the reverse-pass portion is positioned.

In the depicted design, the impingement plate 52 makes up part of the hub/case-offshoot passage wall (and acts to seal the wall at this point). This avoids any additional wall thickness penalty when the impingement plate is introduced (that is, it avoids a thicker section that would be present if a separate wall and impingement plate 52 were present). In this design no flow is permitted through the impingement plate 52 at this location. In other examples, small dust holes could be incorporated in the impingement plate here to alleviate the risk of blockage or to increase the coolant flow through the hub and case portions of the trailing-edge T, if desired.

Before exiting the aerofoil 40 at the trailing-edge T, the coolant runs through a staggered bank of pedestals 48 to increase the coolant heat pick-up. In this example there are five pedestal rows. In other embodiments, a different number of pedestal rows could be used, or different heat transfer enhancement features.

The midspan reverse-pass passage 41 is designed to pick-up significant amounts of heat from the midspan. This is facilitated by the presence of heat transfer enhancement features such as pedestals 48, which in turn increase the pressure drop within the passage. As such, this pressure drop allows for the coolant to be routed underneath the off-midspan passages 42 (see below) and back for exhaust towards the trailing-edge T, along the hub and case portions of the trailing edge T. At the trailing-edge T, the mainstream pressure is relatively low, and can accommodate the large pressure drop through the midspan reverse-pass passage 41, whilst maintaining a safe pressure margin.

As mentioned above, this results in the midspan reverse-pass passages having a portion in which the coolant flows in reverse-pass direction (i.e. from the trailing-edge T to the leading-edge L) before being routed radially and then back to the trailing-edge T in a 'normal' or 'non-reverse-pass' direction. Preferably the reverse-pass portion extends 20% or more along the streamwise suction surface distance of the aerofoil, optionally 30% or more, optionally 50% or more, further optionally 70% or more, and still further optionally 90% or more of the aerofoil suction side streamwise surface distance.

The midspan reverse-pass passage 41 (along with the off-midspan reverse-pass passages 42) are preferably contained within the suction-side wall of the aerofoil ('wall' used here to describe the material between the external surface of the aerofoil and the main plenum 51). This is because the length of the reverse-pass system is maximised when positioned on the suction-side S of an aerofoil 40. The length of the reverse-pass portion of the passages is also maximised by introducing the coolant as far back along the suction-side S as possible, terminating the reverse-pass portion as close to the leading-edge as possible. This preference for the position of the inlet to the reverse pass passages 41, 42 fits well with the preference for the inlet 44 to the midspan trailing-edge passages 43 to also occur as far back as is manufacturable, towards the trailing-edge T.

As such the inlets to the passages 41,42,43 can be co-located. As mentioned above the inlets 44 can be at 60% or greater along the streamwise surface distance on the suction side S, optionally at 70% or greater, further optionally at 80% or greater, and still further optionally at 90% or greater.

The beginning of the reverse-pass passages 41, 42 are situated between 20-80% of the aerofoil 40 span, in this design, to coincide with the span of the midspan trailing-edge passages 43. However, other configurations are also possible.

The off-midspan reverse-pass passages 42 are now discussed in more detail.

There are two off-midspan reverse-pass passages 42 in the depicted design. These feed an outlet or exhaust 46 on the suction-side S. The exhaust 46 may be in the form of cooling holes (e.g. film cooling holes) as depicted, but other arrangements such as a slot are possible. As discussed above, these passages 42 begin at 60-70% along the streamwise surface distance, in the depicted example. The passage 42 on the hub side is positioned between 20-40% span, and the passage 42 on the case side is positioned between 60-80% span. That is, in this example, each of the passages 42 is 20% of the span width before they merge into the plenum 47 (discussed below).

The off-midspan reverse-pass passages 42 run towards the leading-edge L of the aerofoil 40. Both passages 42 can contain e.g. two rows of staggered pedestals 48 to increase coolant heat pick-up in the positions where the external heat load is highest. Other examples may use greater or fewer pedestals 48, or different heat transfer enhancement features, e.g. turbulator ribs 49 (depicted in FIG. 4), dimples, roughness elements, or impingement systems.

In the depicted example, the off-midspan reverse-pass passages 42 begin to converge at around 35% streamwise surface distance (i.e. 35% of the distance from the leading-edge L to the trailing-edge T), merging fully into a single plenum 47 at 25% streamwise surface distance. The plenum 47 extends to the outlets 46 provided at or in the vicinity of the leading edge L. The outlets 46 are thus closer to the leading edge L than the trailing edge T. Preferably, the outlets 46 are within 30% of the distance from the leading edge (L) to the trailing edge (T), optionally within 20%, further optionally within 10%, and still further optionally within 5%.

As such, the reverse-pass portion of passages 42 include the plenum 47, and the reverse-pass portions therefore extend over 60-70% of the streamwise suction surface distance in this example. In other examples, the merge positions can be altered to adjust the heat transfer characteristics and/or pressure loss characteristics of the off-midspan reverse-pass passages 42 and the midspan reverse-pass passage 41 (as the location of the plenum 47 affects the length of the various portions of the midspan reverse-pass passage 41). Preferably the off-midspan reverse-pass passages (including the merged section in the plenum 47) extend 20% or more along the streamwise suction surface distance of the aerofoil, optionally 30% or more, optionally 50% or more, further optionally 70% or more, and still further optionally 90% or more of the aerofoil suction side streamwise surface distance.

The shared plenum 47 occupies 90% or more, and optionally the entire span, of the aerofoil 40, and in this example feeds two rows of film cooling holes 46 on the suction-side S. In other embodiments, the shared plenum may feed a different number of film-cooling rows. Also, the plenum may not extend across the entire span. The pressure loss through the off-midspan reverse-pass passages 42 can be controlled to give the optimum blowing ratio across the film-cooling rows 46.

The off-midspan reverse-pass passages 42 are designed for lower external heat loads than the midspan reverse-pass passage 41. The level of coolant heat pick-up is partly controlled by local arrays of heat transfer enhancement features 48, 49. The midspan reverse-pass passage 41 is designed to drop more pressure and pick up more heat than the off-midspan reverse-pass passages 42. Consequently, as discussed above, the midspan reverse-pass passage 41 can be routed to the hub and case regions of the aerofoil 40, where the external heat load is relatively low and coolant heat pick-up is less important. This routing is achieved via an internal overpass/underpass passage arrangement which is clearly shown in the various figures (e.g. FIGS. 10, 12 and 14). In this arrangement, the two parts of the midspan reverse-pass passage 41 dip underneath the off-midspan reverse-pass passages 42, away from the suction side S, before coming back up to the suction side S beyond the off-midspan reverse-pass passages 42. That is, the portions of the midspan passage 41 extending in a direction predominantly from the first lateral edge to the second lateral edge of the aerofoil blade or vane 40 are separated from the suction side S by the off-midspan reverse-pass passages 42.

The off-midspan reverse-pass passages 42 drop less pressure than the midspan reverse-pass passage 41, and can therefore be safely exhausted through the film cooling holes 46 towards the leading edge on the suction-side S. The blowing ratio of these holes can be controlled by the pressure loss through the off-midspan reverse-pass passages 42, allowing a cooling film with optimum blowing ratio to develop.

The relatively low pressure drop in the off-midspan reverse-pass passages affects the selection of the surface locations in which the coolant is exhausted into the mainstream. In general, a minimum pressure ratio of 1.02-1.03 between the coolant and the local mainstream is required to mitigate the risk of mainstream ingestion. In some examples it may be desirable to position outlets in locations that compromise the aerodynamic performance of the turbine to maintain the aerofoil at acceptable temperatures.

As mentioned above, the different types of reverse-pass passage 41, 42 cater for the 3D distribution of the external heat load. The midspan reverse-pass passage 41 is designed to provide more internal cooling than the off-midspan passages 42, because the external heat load is higher at midspan. The mass flow rate through each of the three reverse-pass portions of the passages 41, 42 is approximately the same in the depicted example. In other examples, the coolant mass flow rate through the midspan reverse-pass passage 41 could be increased, for example by adjusting the trailing-edge geometry through which the midspan reverse-pass flow is exhausted into the mainstream. Another option is to modify the radial split between passages (in the discussed example, the reverse-pass passage portions are located between 20-80% radial span and the 'non-reverse flow' portions of the midspan reverse-pass passage 41 make up 0-20% and 80-100% radial span) may be adjusted to modify the mass flow rate through each type of passage.

Another advantage of the design, also mentioned above, relates to the cooling at the end-wall regions. In prior art designs, at least one of the near end-wall regions (e.g. the regions at 0 and 100% span height) is fed with cooling flow of the highest cooling potential (i.e. 'fresh' coolant). In the presented design, both end-wall regions are fed with coolant at lower cooling potential. Coolant at the highest cooling potential is fed directly only to the central (20-80% span, in the depicted example) region. This is advantageous because the external heat load at midspan is generally higher than near the end-walls. This means that current systems generally experience thermal degradation at midspan first. The present design mitigates against that.

That is, the current design aims to ensures that internal convective heat transfer (coolant heat pick-up) is highest in places where the external heat load is highest, in order that the wall temperature is more uniform with span. Areas that are relatively over-cooled in current designs (e.g. near the end-walls) have lower coolant heat pick-up in the design presented. This is partly achieved via the presented internal overpass/underpass passage arrangement.

The effect of the design of FIGS. 4-15 is illustrated in the graph of FIG. 16. FIG. 16 plots the predicted wall temperature distribution on the suction-side of the aerofoil (with the trailing edge zone marked 'TE'), for a standard aerofoil cooling system (marked 'Baseline', and in which the trailing edge coolant flow enters through an impingement plate and exits through a trailing edge pedestal bank, and leading edge film cooling holes are fed by a radially fed plenum in the leading edge) and the discussed design (marked 'Reverse-pass system'). The current reverse-pass system reduces the maximum wall temperature by 20 K and generates a flatter wall temperature profile than the standard design.

Figure 17:
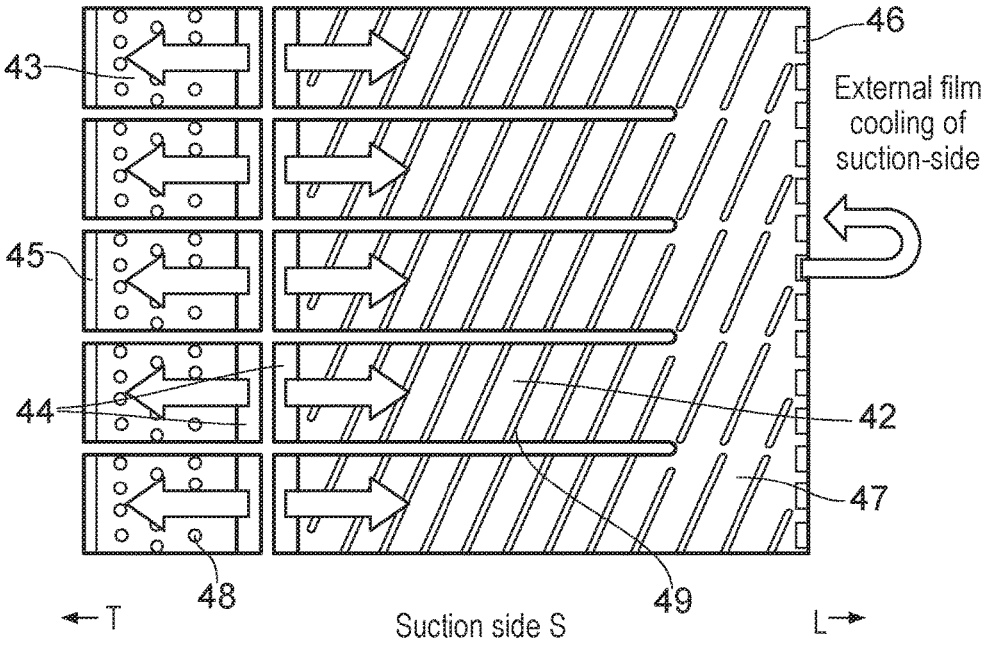
FIG. 17 is a schematic plan for a design of a 1D reverse pass cooling system.

The system of FIGS. 4-16 is designed for an external radial gas temperature distribution that is hottest in the middle and coolest at the hub and case. For a radial gas temperature that is more uniform with span, a '1D' reverse-pass system as illustrated in FIG. 17 may be preferable. This is referred to as a '1D' reverse-pass system because the flows are only in the axial/streamwise direction, and not in the radial direction and there is no underpass/overpass aspect to the arrangement of the passages. However, as in the '3D' system, there are trailing edge passages 43, which have only 'normal' flow; reverse pass passages 42 that have only reverse flow, and cover both midspan and off-midspan sections of the aerofoil; and a leading edge plenum 47, stretching across the entire aerofoil 40 span, through which the reverse pass passages 42 can be exhausted. As with the '3D' design, the specific number of passages and their lateral widths can be adjusted according to requirements. Also, the precise location of the coolant passage entry point 44 can be varied.

Figure 18:
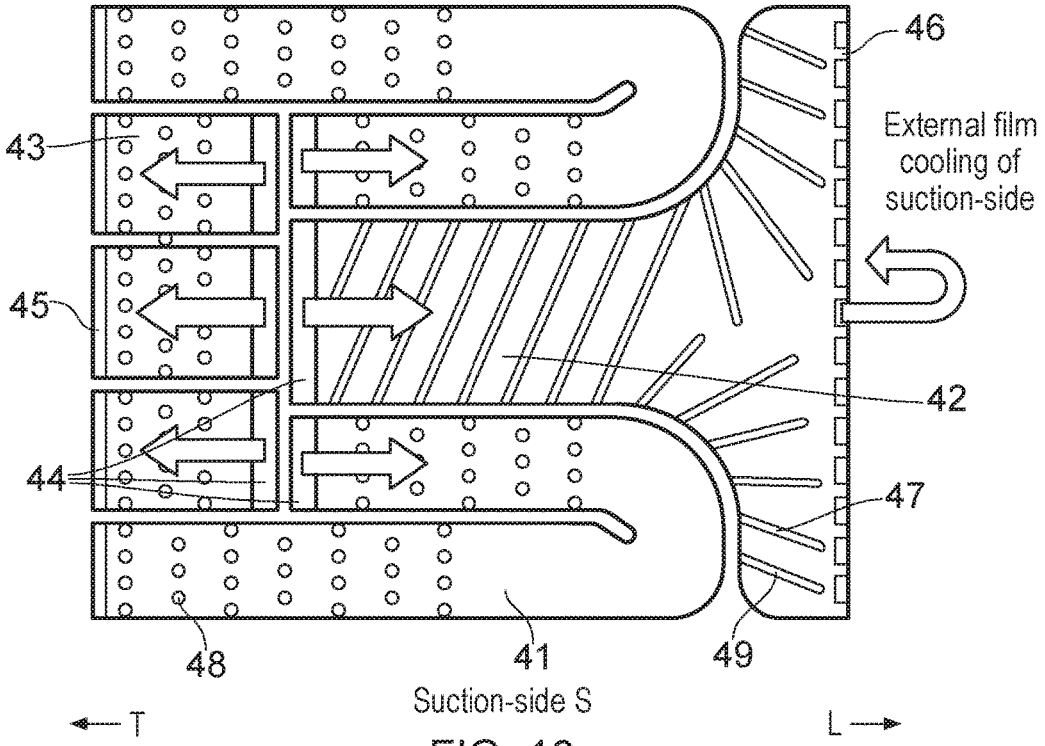
FIG. 18 is a schematic plan for a design of a 2D reverse pass cooling system.

A '2D' reverse-pass system as illustrated in FIG. 18 could be implemented if there is a different balance between the external radial temperature distribution, the coolant mass flow rate split between the trailing edge T and the suction-side S rows of cooling holes, and the pressure loss that can be sustained by each ejection location (e.g. the trailing-edge T and the suction-side S film cooling rows). As in the '3D' system, there are: mid-span trailing edge passages 43, which have only 'normal' flow; a reverse pass passage 42 that has only reverse flow (in this case, positioned at midspan); and reverse pass passages 41 that have a portion operating in reverse flow and a portion operating in normal flow (in this case positioned off-midspan). There is also a leading edge plenum 47, stretching across the entire aerofoil 40 span, through which the reverse pass passage 42 can be exhausted. As with the '3D' design, the specific number of passages and their lateral widths can be adjusted according to requirements. Also, the precise location of the coolant passage entry point 44 can be varied.

Figure 19:
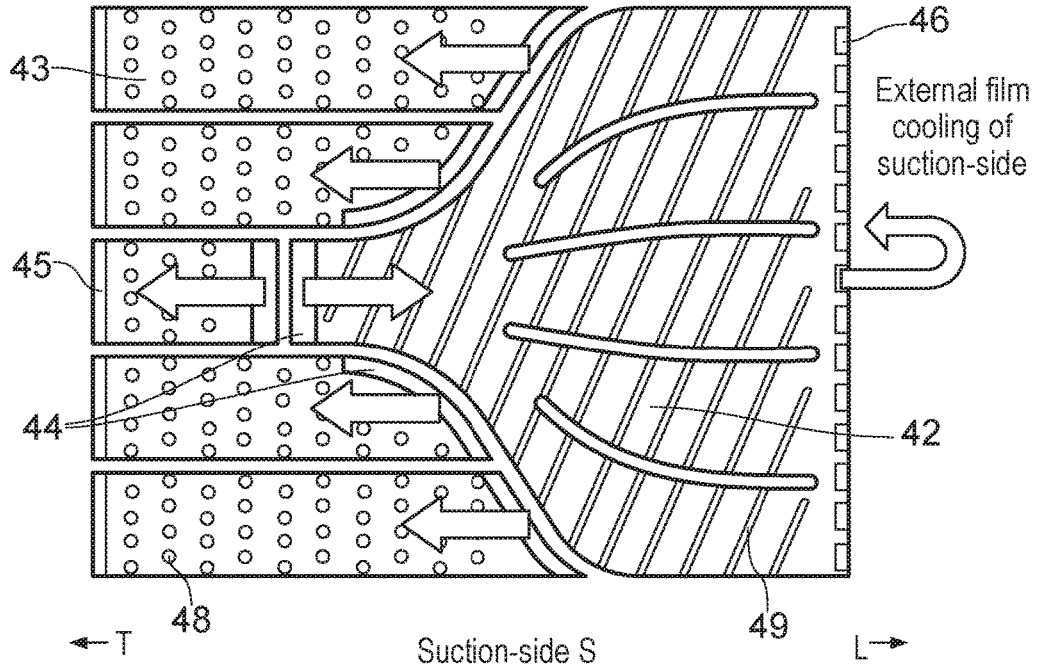
FIG. 19 is a schematic plan for a design of an alternative 1D reverse pass cooling system.

A modified 1D reverse-pass system is illustrated in FIG. 19. Such a system could be implemented for situations where the radial temperature distribution is somewhere between the ideal for the 1D reverse-pass system and the ideal for the 2D reverse-pass system. In this system, there are: mid-span trailing edge passages 43, which have only 'normal' flow; and reverse pass passages 42 that have only reverse flow (covering both midspan and off-midspan). However, there are not any reverse pass passages that have a portion operating in reverse flow and a portion operating in normal flow. As a result, this system allows for the inlet position 44 to vary across the span of the aerofoil 40. This allows, the inlet 44 at the midspan (the hottest position) to be positioned as far back towards the trailing edge T as desired, to provide the long reverse pass passage 42 and the short normal pass passage 43, but for the inlet 44 to be also positioned less far back at the cooler outer edges. Once again, there is also a leading edge plenum 47, stretching across the entire aerofoil 40 span, through which the reverse pass passage 42 can be exhausted. As with the '3D' design, the specific number of passages and their lateral widths can be adjusted according to requirements. Also, the precise location of the coolant passage entry point 44 can be varied.

Figure 20:
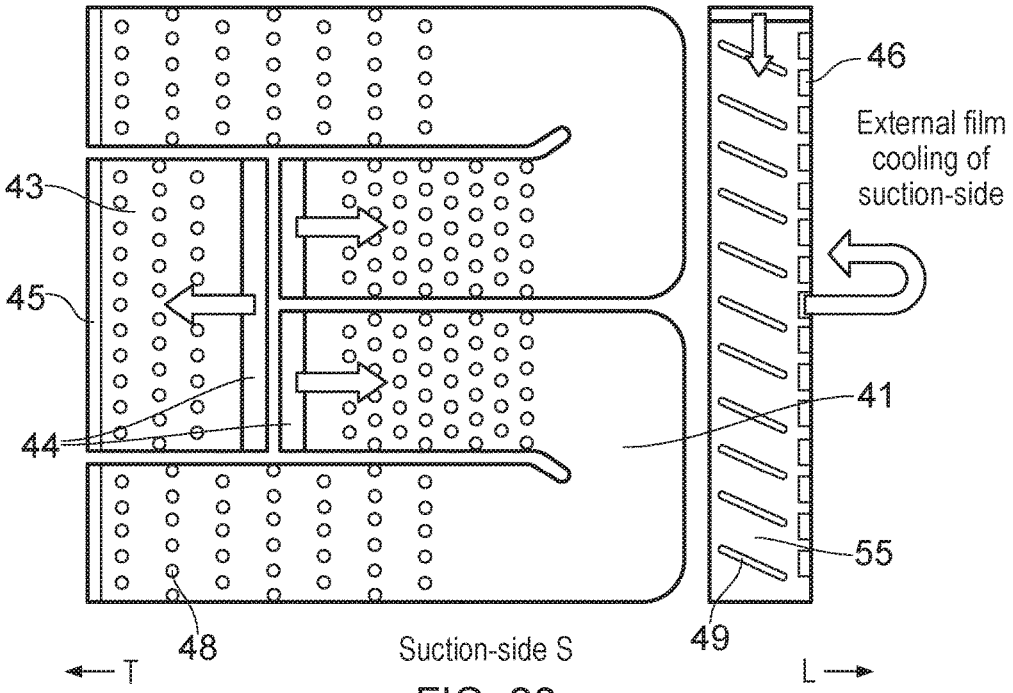
FIG. 20 is a schematic plan for a design of a 2D reverse pass cooling system with only trailing edge exhaust.
Figure 21:
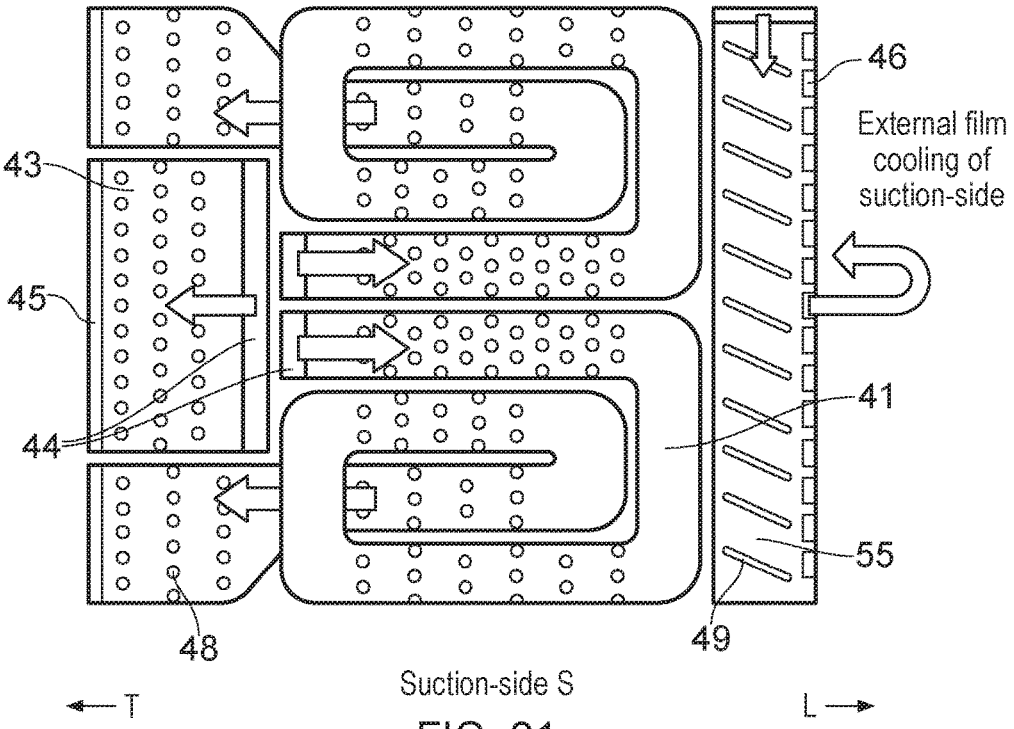
FIG. 21 is a schematic plan for a design of a 3D reverse pass cooling system with only trailing edge exhaust.

For systems in which the internal coolant pressure loss before the suction-side S film cooling holes must be minimised (e.g. because these rows already operate at a low pressure margin verging on the ingestion limit), it may be preferable to route all of the reverse-pass passages out of the trailing-edge T and feed the suction-side film cooling holes with a separate plenum. FIGS. 20 and 21 illustrate design variants for this purpose which aim to maximise the amount of reverse-pass in the system and maximise internal convective heat transfer at midspan. These designs incorporate a normal flow passage 43 for the trailing edge midspan, with two passages 41 having reverse pass and normal flow portions covering both midspan and off-midspan. In both designs a separate plenum 55, which can be fed from one or both edges, is provided at the leading edge. As with the '3D' design, the specific number of passages and their lateral widths can be adjusted according to requirements. Also, the precise location of the coolant passage entry point 44 can be varied.

For an extreme external radial temperature distribution in which the external film temperature at hub or case is lower than the local internal coolant temperature (i.e. heat transfer is reversed, travelling from aerofoil to external flow), a serpentine design such as illustrated in FIG. 21 could be implemented. Here, coolant picks up heat at midspan in a first reverse pass portion, rejects heat back into the mainstream at hub and case normal flow portions (re-cooling the coolant), picks up heat in the off-midspan region in a further reverse pass region, and is finally ejected through the trailing-edge. As such, this design has multiple reverse-pass portions in passage 43.

In all of the described designs, different specific numbers of channels, different number and type of heat transfer augmentation mechanisms, differing passage widths and lengths etc. may be used. It will also be apparent that other modifications to the designs may be made whilst obtaining the benefit of the improved cooling.

The invention claimed is:

1. An aerofoil blade or vane for the turbine of a gas turbine engine, the aerofoil blade or vane comprising:

an aerofoil leading edge;

an aerofoil trailing edge;

an aerofoil suction side; and a first reverse-pass coolant passage, extending within the aerofoil blade or vane;

wherein the first reverse-pass coolant passage includes a midspan reverse-pass portion positioned at the aerofoil blade or vane midspan region on the aerofoil suction side, which is arranged in a predominantly trailing edge to leading edge direction and which portion extends along 20% or more of the aerofoil suction side streamwise surface distance, further comprising an internal pressure-side plenum that is connected to an aerofoil coolant inlet located at one of the aerofoil blade or vane lateral edges, and which is further connected to the reverse-pass coolant passage via a cooling passage inlet, wherein the midspan reverse-pass portion of the reverse-pass coolant passage and the cooling passage inlet exist only at positions between 20% and 80% along the extent of the aerofoil blade or vane in a direction predominantly from a first lateral edge to a second lateral edge of the aerofoil blade or vane, wherein the first reverse-pass coolant passage includes a portion extending from an outlet of the midspan reverse-pass portion in a direction predominantly from a first lateral edge to a second lateral edge of the aerofoil blade or vane.

2. An aerofoil blade or vane according to claim 1, further comprising a second reverse-pass coolant passage that extends along the suction side to a coolant outlet closer to the aerofoil leading edge than the trailing edge.

3. An aerofoil blade or vane according to claim 2, wherein the outlet for the second reverse-pass coolant passage is within 30% of the distance from the leading edge to the trailing edge.

4. An aerofoil blade or vane according to claim 2, wherein the outlet for the second reverse-pass coolant passage comprises at least one row of suction-side film cooling holes.

5. An aerofoil blade or vane according to claim 1, wherein the reverse-pass portion extends for 30% or more of the aerofoil suction side streamwise surface distance.

6. An aerofoil blade or vane according to claim 1, wherein said internal pressure-side plenum extends across 50% or more of the pressure-side surface.

7. An aerofoil blade or vane according to claim 1, wherein the cooling passage inlet is positioned at 60% or greater along the streamwise surface distance on the suction side.

8. An aerofoil blade or vane according to claim 1, further comprising:

a plurality of second reverse-pass coolant passages; and a leading edge plenum, extending 90% or more along the leading edge within the aerofoil blade and vane, in fluid communication with a coolant outlet at the leading edge;

wherein the leading edge plenum forms a final section of each of the second reverse-pass coolant passages.

9. An aerofoil blade or vane according to claim 1, wherein said cooling passage inlet is an impingement plate.

10. An aerofoil blade or vane according to claim 1, wherein the first reverse-pass coolant passage extends to a coolant outlet closer to the aerofoil trailing edge than the aerofoil leading edge, the aerofoil blade or vane further comprising a second reverse-pass coolant passage which extends along the suction side to a coolant outlet closer to the aerofoil leading edge than the trailing edge.

11. An aerofoil blade or vane according to claim 10, wherein the outlet for the first reverse-pass coolant passage is within 30% of the distance from the trailing edge to the leading edge.

12. An aerofoil blade or vane according to claim 11, wherein the outlet for the first reverse-pass coolant passage is a trailing-edge slot.

13. An aerofoil blade or vane according to claim 1, wherein the portion extending in a direction predominantly from the first lateral edge to the second lateral edge of the aerofoil blade or vane extends for a distance of 20% or more of the leading edge.

14. An aerofoil blade or vane according to claim 1, wherein the first reverse-pass coolant passage includes a normal-pass portion, extending along the suction side, from an outlet of the portion extending from a first lateral edge to a second lateral edge, in a predominantly leading edge to trailing edge direction.

15. An aerofoil blade or vane according to claim 10, wherein the portion of the first reverse-pass coolant passage extending in a direction predominantly from the first lateral edge to the second lateral edge of the aerofoil blade or vane is separated from the suction side by the second reverse-pass coolant passage.

16. An aerofoil blade or vane according to claim 14, wherein the normal-pass portion extends along a lateral edge of the aerofoil blade or vane.

17. A gas turbine comprising at least one aerofoil blade or vane according to claim 1.

* * * * *